US006580023B2

(12) United States Patent
Belli

(10) Patent No.: US 6,580,023 B2
(45) Date of Patent: Jun. 17, 2003

(54) CONVERTIBLE DRUMHEAD

(75) Inventor: Remo D. Belli, Sherman Oaks, CA (US)

(73) Assignee: Remo, Inc., Valencia, CA (US)

( * ) Notice: Subject to any disclaimer, the term of this patent is extended or adjusted under 35 U.S.C. 154(b) by 0 days.

(21) Appl. No.: 09/928,727

(22) Filed: Aug. 13, 2001

(65) Prior Publication Data

US 2003/0029301 A1 Feb. 13, 2003

(51) Int. Cl.[7] ..... G10D 13/04
(52) U.S. Cl. ..... 84/411 R; 84/421
(58) Field of Search ..... 84/411 R, 414, 84/416, 421, 411 A

(56) References Cited

U.S. PATENT DOCUMENTS 4,308,782 A 1/1982 Hartry
4,362,081 A 12/1982 Hartry
4,469,001 A * 9/1984 Hartry ..... 264/342 R
5,091,248 A 2/1992 Belli
5,349,891 A 9/1994 Belli
5,385,076 A 1/1995 Belli
5,404,785 A 4/1995 Belli
5,581,044 A 12/1996 Belli et al.
6,215,053 B1 * 4/2001 Adinolfi ..... 84/411 R

* cited by examiner

*Primary Examiner*—Kim Lockett
(74) *Attorney, Agent, or Firm*—Rapkin & Gitlin

(57) ABSTRACT

An improved drumhead comprising a substantially annular hoop having a generally planar upper member spaced apart from a generally planar lower member, a circumferential inner rim and a circumferential outer rim. Also provided is a film material or membrane, which is generally co-planar with the annular hoop, for constituting a drumming surface, which extends flat across the area defined within the circumferential inner rim and the circumferential outer rim. The drumhead is adaptable for use with a large variety of percussion instruments including toms, snare drums, bass drums, tambourines, congas, bongos and many other types of ethnic and other drums. The invention can also be employed separately as a hand held drum with the flat annular hoop section of the instrument functioning as a drumshell.

22 Claims, 7 Drawing Sheets

FIG. 2
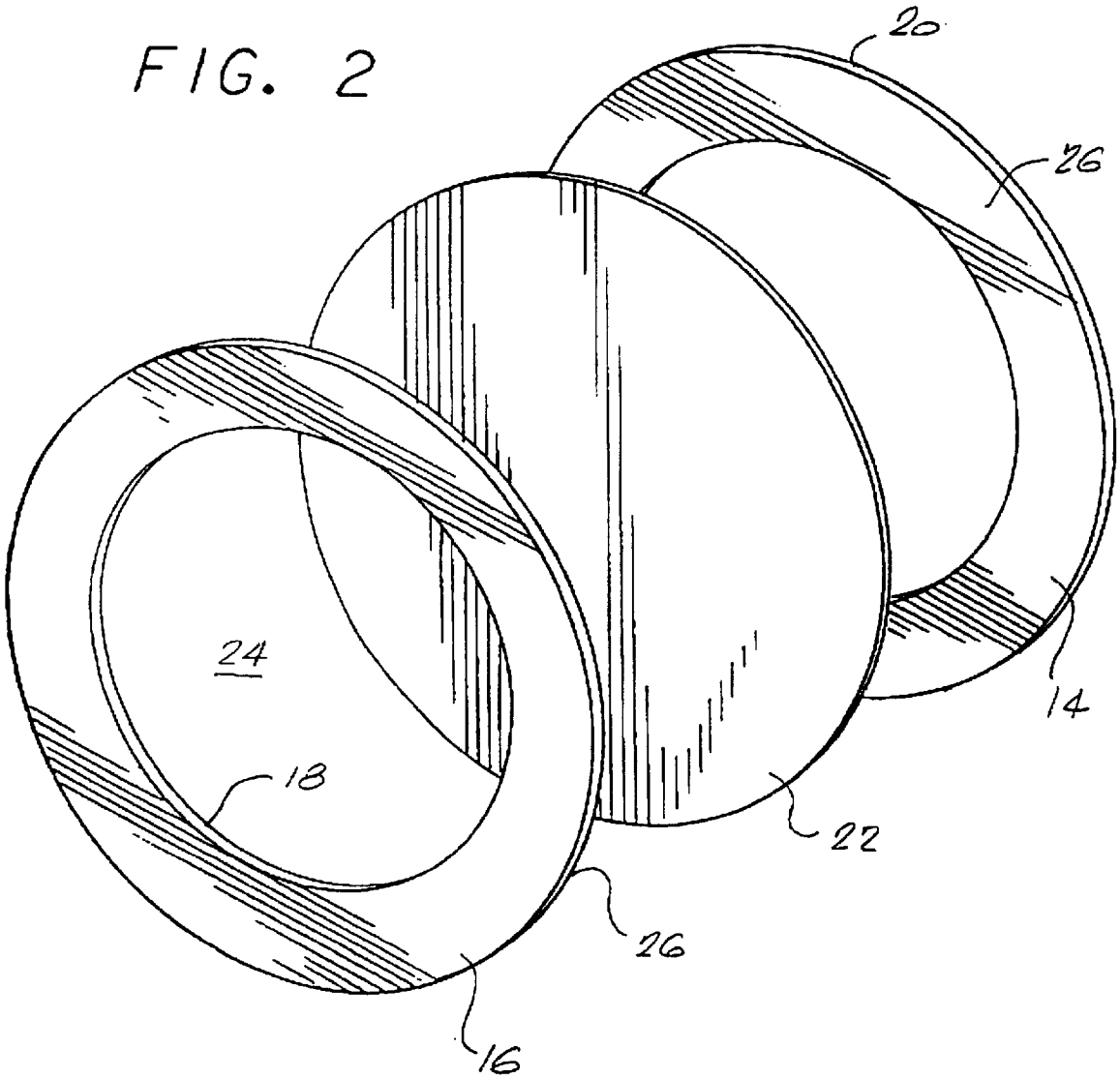
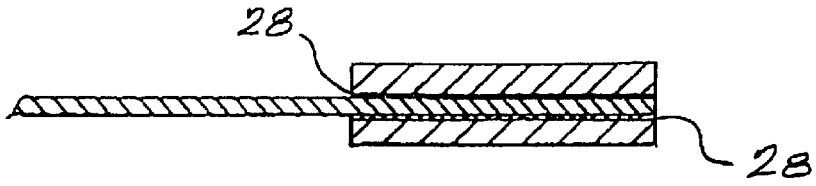
FIG. 3

FIG. 4
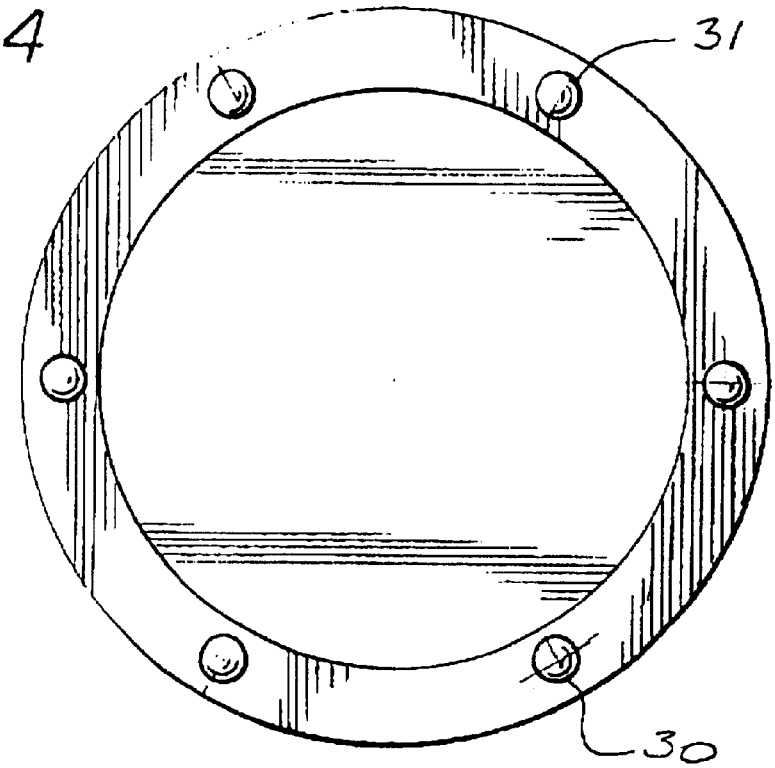
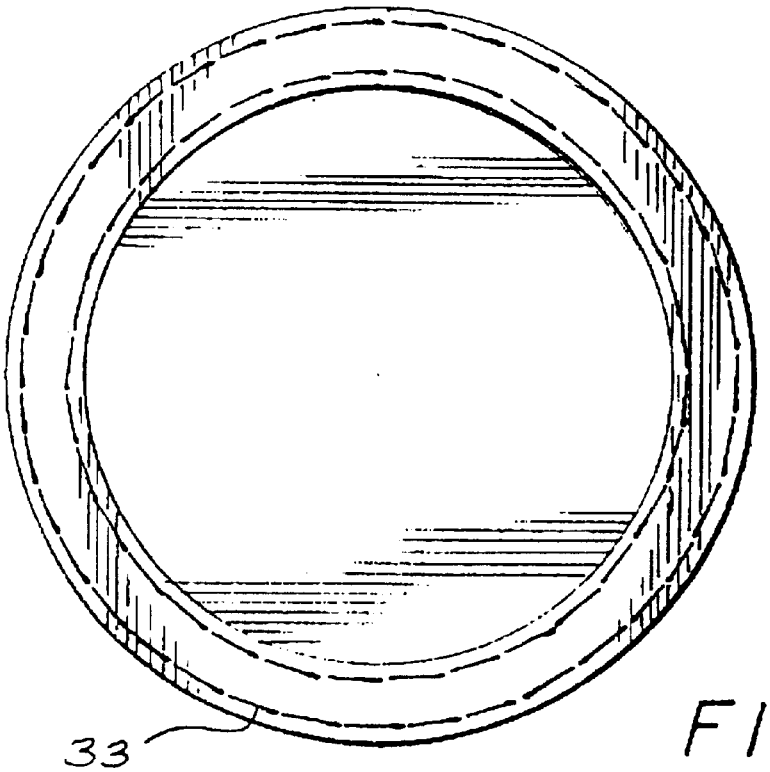
FIG. 5

FIG. 8
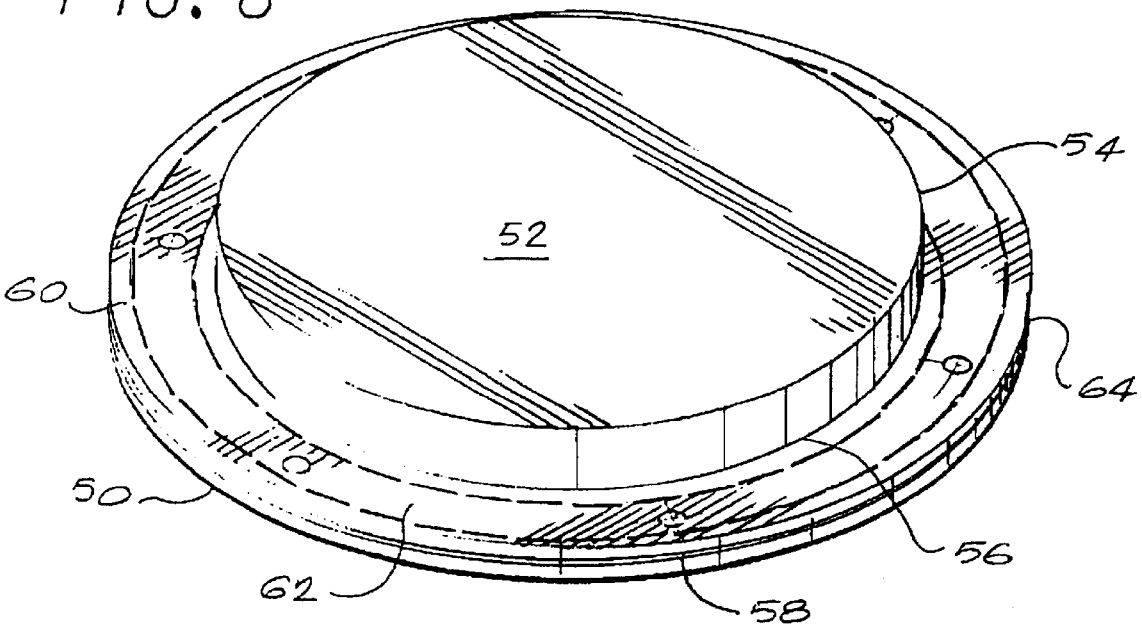
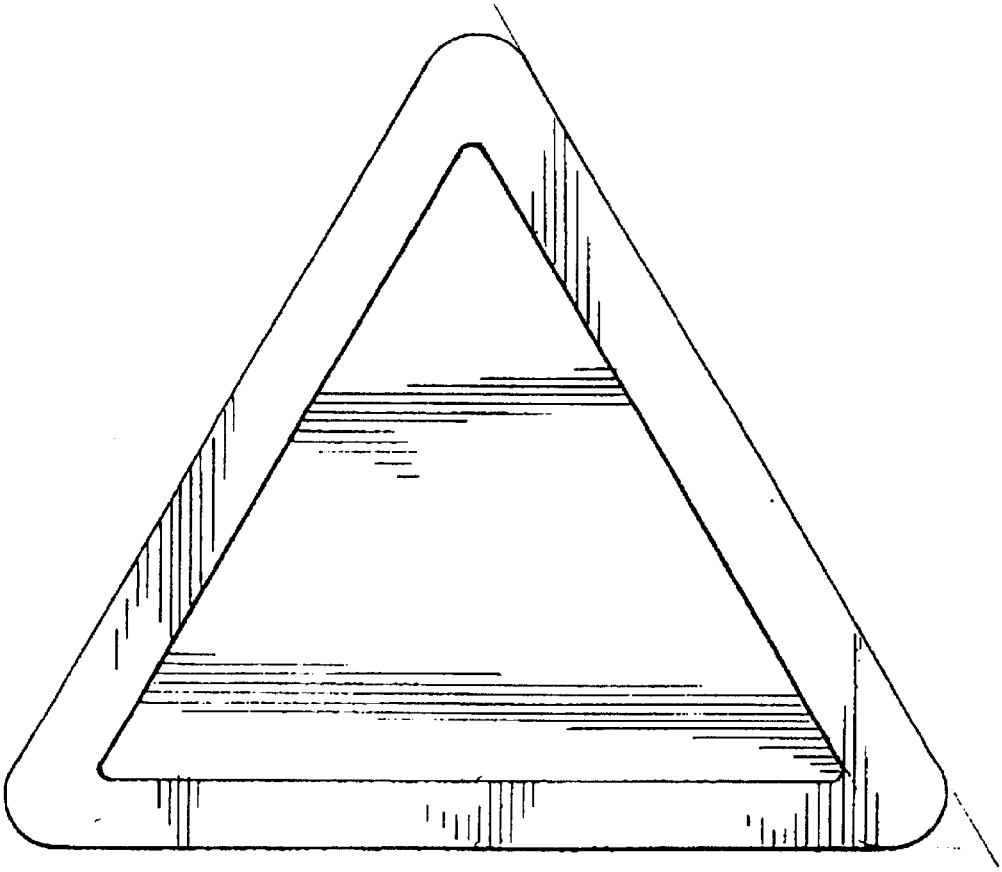
FIG. 9

FIG. 10
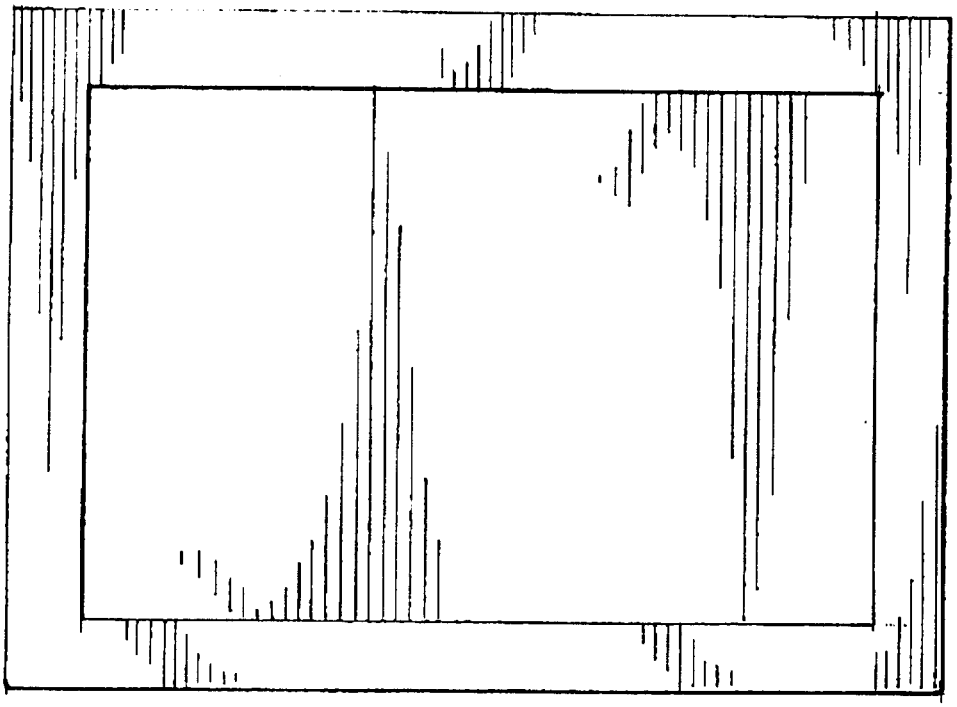
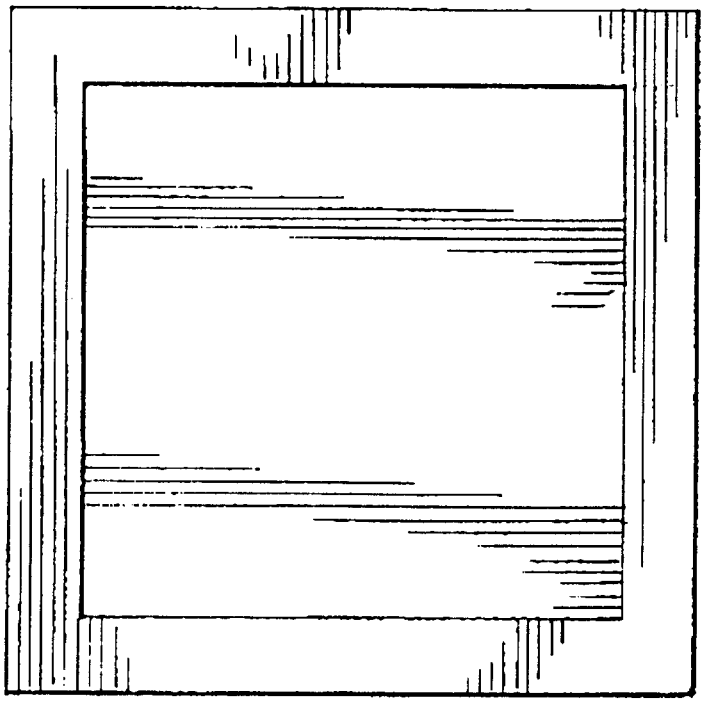
FIG. 11

FIG. 12
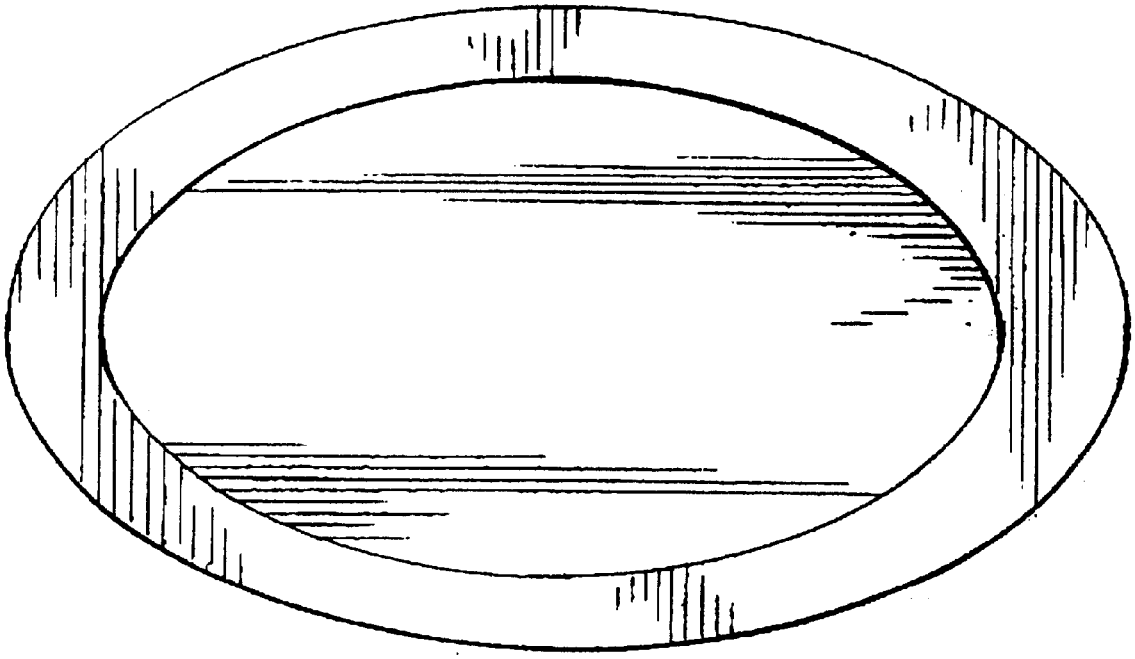
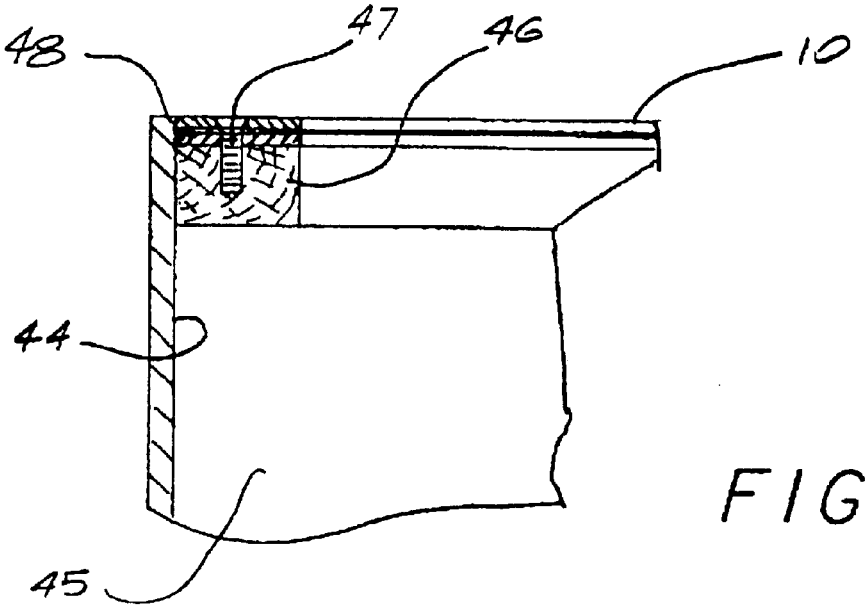
FIG. 13

CONVERTIBLE DRUMHEAD

BACKGROUND OF THE INVENTION

1. Field of the Invention

The present invention relates to musical drums and, more particularly, to an improved percussion device that can be employed as a drumhead in combination with a conventional drum shell or separately, as a hand held instrument.

2. Description of the Prior Art

The drum, which we understand and appreciate primarily in a musical context, originated thousands of years ago. Then, much more so than now, drums were used as a means of communication to enable people in distant villages to speak to one another, e.g., send messages and warnings, and the like. The earliest drums were likely fashioned from hollowed out logs. Animal skins that were stretched across the openings served as the contact surface or batter head. Drums have evolved to the instruments that we are familiar with today, including the more contemporary toms, snare drum and bass drum, and the ethnic percussion group of instruments, including the conga, bongo, djembes and others.

Toms, snares and bass drums typically comprise a cylindrical shell usually fashioned from wood, metal or a synthetic material. A separate drumhead is attached and covers one or both ends of the shell to act as the contact surface for producing the desired drum sounds.

Drum shells are constructed so that the shell wall, which is normally annular, is orientated perpendicularly to the plane of the drumhead. A conventional drumhead is formed and bent at its periphery to enable tension to be applied at right angles, i.e. by employing a plurality of devices such as drum lugs, connected to the shell to pull at the periphery of the head (in a direction normal to the head surface) to stretch and tension the film. The direction of the tensioning effort is coincident with the head's vertical axis, more specifically coincident with the generally vertical plane of the bent or angular portion of the section of the head disposed around its periphery.

In general, conventional heads comprise a vibratile sheet or membrane, which is stretched over an annular hoop having an inner and an outer rim defining a channel. Typically, the channel is filled with a type of adhesive or resin into which the bent peripheral portion of the drumhead is inserted. The adhesive or resin is then permitted to cure, enabling the film a fixed and secure connection to the hoop.

The drumhead is placed over one end (or both ends) of a drum shell. A standard rim mounted counterhoop is then placed over and in tight contact with the annular hoop to secure the drumhead to the shell. The counterhoop is then employed in combination with any suitable tensioning mechanism to tension the drumhead, as necessary. Pre-tensioned or pre-tuned heads are assembled with the drum shell in the same fashion.

Placing a drumhead over a conventional shell involves engaging the head with the shell's bearing edge, which comprises the outermost end section(s) of the shell. The process of tensioning the head requires the film or membrane to be pulled and stretched tightly across and against the bearing edge. The sound produced by the head directly relates to the shape and hardness of the bearing edge, and the friction the edge creates. The vibrations that produce the drum sound are the result of these characteristics. However, "friction tension," as this relationship is often called, has a number of drawbacks. Pulling the head against the bearing edge will usually wrinkle the film, which can cause distortion in the sound. Also, aspects of the sound, more precisely the vibrations, are likely to be absorbed by the bearing edge and the drum shell, which diminishes the sound intensity and the quality of the instrument.

A hand drum, such as the kind disclosed in U.S. Pat. No. 5,349,891 to Belli, is an example of a conventional drumhead that is embellished or improved to enable the head to be adapted for different uses, such as in combination with a conventional drum shell. This device may also be employed independently as a single headed hand held instrument, which serves as both a shell and a head in one integrally formed unit. In either case, however, the walls of the shell are conventionally oriented at a right angle generally relative to the horizontal axis of the head.

Thus, it is desirable to provide a versatile and unique drumhead construction for use separately as a hand held drum, or for use in combination with all types of pre-tuned and non-pretuned drums, including, without limitation, toms, snares, bass drums, congas and other ethnic drums. As a hand held drum in its preferred embodiment, the instrument employs a construction in which the strike or contact surface of the head, i.e., the film or membrane portion, is situated in a co-planar orientation with a separate hoop component, which bonds securely to the top and bottom surfaces of the film and additionally functions as a drum shell. This improved instrument enables the tensioned flat film, which combines with a flat shell, to vibrate significantly more freely than the film is capable of doing when simply joined with a standard rim mounted counterhoop in combination with a conventional shell. Without the drawbacks normally associated with "friction tension," the improved instrument produces sounds with more quality and integrity of tone.

The invention also has other applications. Employing proper support means attached to the inside of the shell wall, the drumhead can be supported and fixed in place at the shell opening, near or substantially even with the circumventing edge. The improved drumhead can also be adapted over the rim portion of a conventional shell and then mounted on the shell using conventional tensioning mechanisms. A generally flat counterhoop, which is formed to coincide generally with the dimensions and configuration of the annular hoop, can be placed over the drumhead in contact with the hoop, and secured there by suitable means to assist in the tensioning process.

SUMMARY OF THE INVENTION

In its preferred embodiment, the present invention provides an improved drumhead comprising a substantially annular hoop having a generally planar upper member spaced apart from a generally planar lower member, a circumferential inner rim and a circumferential outer rim. Also provided is a film material or membrane for constituting a drumming surface, which extends flat across the area defined within the circumferential inner rim and the circumferential outer rim. The film material is generally co-planar with the annular hoop.

The drumhead, either in its flat film or bent film embodiment, is adaptable for use with a large variety of percussion instruments including toms, snare drums, bass drums, tambourines, congas, bongos and many other types of ethnic and other drums. The invention can also be employed separately as a hand held drum with the flat annular hoop section of the instrument functioning as a drumshell.

The drumhead can be pre-tuned or tunable. Tunable embodiments of the invention require a tensioning mechanism, which may include any suitable bolt or rod that can be inserted into the plurality of spaced openings fashioned within the body of the annular hoop. A lug nut or some other similar type of device joining with the tensioning bolt or rod, when rotated, will create a force normal to the plane of the hoop to cause a tightening of the drumhead for tuning the device. The tensioning mechanisms can be mounted either on the inside or on the outside of the shell in any suitable location to achieve the intended objective. A flat counterhoop may also be employed to achieve a proper tensioning of the head.

Construction of the invention can involve the use of a plurality of layers of film and high density fiberboard, which acts as the co-planar hoop in shell component. Suitable adhesive is applied to bond the layers. Mechanical means can be used to add strength to the adhesive bond.

Although annular is the preferred shape of the hoop and the film material, other configurations can be employed, including oval, rectangular, square, triangular and a variety of other geometric shapes.

Accordingly, it is an object of the present invention to provide an improved percussion instrument that employs a flat hoop that also functions as a shell to enable the device to be played independently as a hand held instrument.

It is also an object of the present invention to provide an improved percussion instrument that combines a vibratile sheet of film material and an annular or another appropriately shaped hoop that are co-planar in their orientation.

It is yet another object of the present invention to provide an improved percussion instrument that combines a flat film or contact surface with a flat hoop or shell.

It is yet another object of the present invention to provide an improved percussion instrument that combines a flat film, which includes an annular shoulder formed below the rim of the striking surface, with a flat hoop or shell.

It is yet another object of the present invention to provide an improved percussion instrument wherein the surface to surface contact between the flat film and the flat hoop or shell is maximized.

It is yet another object of the present invention to provide an improved percussion instrument that enables the film component of the drumhead to vibrate more freely than the same film is capable of doing when joined with a conventional cylindrical tube-like drumshell.

It is yet another object of the present invention to provide an improved percussion instrument that eliminates the disadvantages of "friction tension".

It is yet still another object of the present invention to provide an improved percussion instrument that produces sounds with more quality and integrity of tone.

Yet still another object of the present invention is to provide an improved percussion instrument that is adaptable for use as a drumhead with a wide variety of drums, including toms, snares, bass drums, congas and others.

Yet still another object of the present invention is to provide an improved percussion instrument that is adaptable for use with a generally flat counterhoop to enable the head to join with a conventional drumshell, and be appropriately tensioned.

Yet still another object of the present invention to provide improved percussion instrument that employs a pre-tuned and non pre-tuned convertible drumhead.

Yet still another object of the present invention to provide improved percussion instrument that is easy and cost effective to manufacture.

Other objects and advantages of the present invention will become apparent in the following specifications when considered in light of the attached drawings wherein a preferred embodiment of the invention is illustrated.

BRIEF DESCRIPTION OF THE DRAWINGS

FIG. 2 is an exploded view of the drumhead of the present invention depicting the individual components of the preferred embodiment of the invention.

FIG. 3 is a cross-sectional view of the drumhead of the present invention taken along line 3—3 of FIG. 1.

FIG. 4 is a front elevational view of the drumhead of the present invention including one alternative mechanical means employed for strengthening the bond between the annular hoop and the membrane.

FIG. 5 is a front elevational view of the drumhead of the present invention including a second alternative mechanical means employed for strengthening the bond between the annular hoop and the membrane.

FIG. 8 is a perspective view of an alternative embodiment of the drumhead of the present invention.

FIG. 9 is a front elevational view of an alternative configuration of the drumhead of the present invention.

FIG. 10 is a front elevational view of another alternative configuration of the drumhead of the present invention.

FIG. 11 is a front elevational view of another alternative configuration of the drumhead of the present invention.

FIG. 12 is a front elevational view of another alternative configuration of the drumhead of the present invention.

FIG. 13 is a cross-sectional view of the drumhead of the present invention shown installed and mounted along the inside walls of a conventional drumshell.

DETAILED DESCRIPTION OF THE PREFERRED EMBODIMENT

Figure 1:
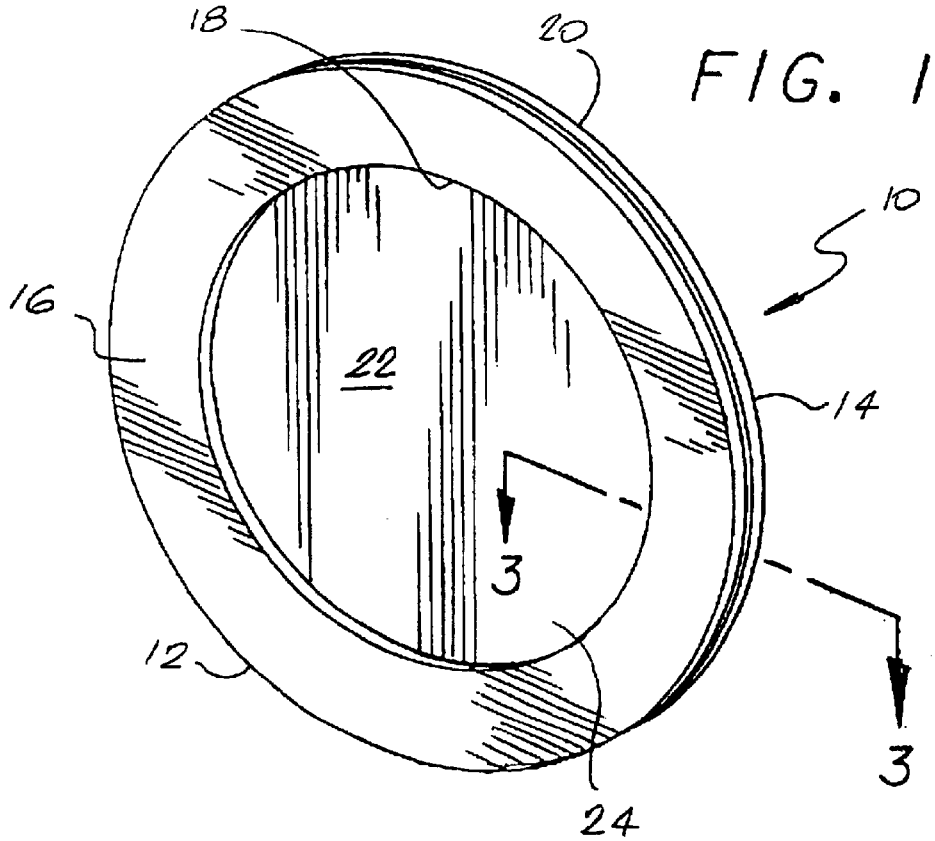
FIG. 1 is a perspective view of the drumhead of the present invention.

FIG. 1 depicts a perspective view of the preferred embodiment of the present invention designated generally as 10. Drumhead 10, which may be pre-tuned (pre-tensioned) or tunable, is comprised of an annular hoop 12 having a generally planar upper member 14 and a generally planar lower member 16, which are parallel to and spaced apart from one another. Hoop 12 includes a circumferential inner rim 18 and a circumferential outer rim 20. A layer of film material 22, which constitutes the contact or drumming surface, extends in a flat linear manner across the area 24 defined within circumferential inner rim 18 and continues across the area 26 defined between the circumferential inner rim 18 and circumferential outer rim 20 to ensure the maximum surface area contact between the components of the annular hoop 12 and film material 22. Film material 22 is generally co-planar with annular hoop 12. Adhesive material 28, such as a polyamide web adhesive, or any other suitable adhesive may be employed to bond and secure film material 22 to and between planar upper member 14 and planar lower member 16. Adhesive material 28 also serves to maintain the appropriate tension on film material 22. Additional mechanical means may be employed to supplement and ensure the proper tensioning of film material 22. This, for example, includes a plurality of radially spaced openings 30 formed within the annular hoop 12. A bolt (not shown) or some other suitable device is inserted into each of these openings, and then may be secured with a nut (not shown) and tightened to add strength to the bond between annular hoop 12 and film material 22. Rivet 31 can also be used for this purpose. Appropriate stitching 33 using any suitable natural or synthetic yarn is also an option.

Planar upper member 14 and planar lower member 16 each may be comprised of one or more layers of material to ensure that annular hoop 12 is maintained at the appropriate strength and resiliency. Construction materials for this purpose include, without limitation, medium to high density fiberboard, polyester film (of varying thicknesses) and aramid/composite fibers.

Drumhead 10 is provided in a variety of sizes and dimensions, and its components are pre-cut accordingly. Various configurations can also be employed, including round (FIG. 1), oval (FIG. 12), rectangular (FIG. 10), square (FIG. 1), triangular (FIG. 9) and assorted other geometric shapes.

Figure 1A:
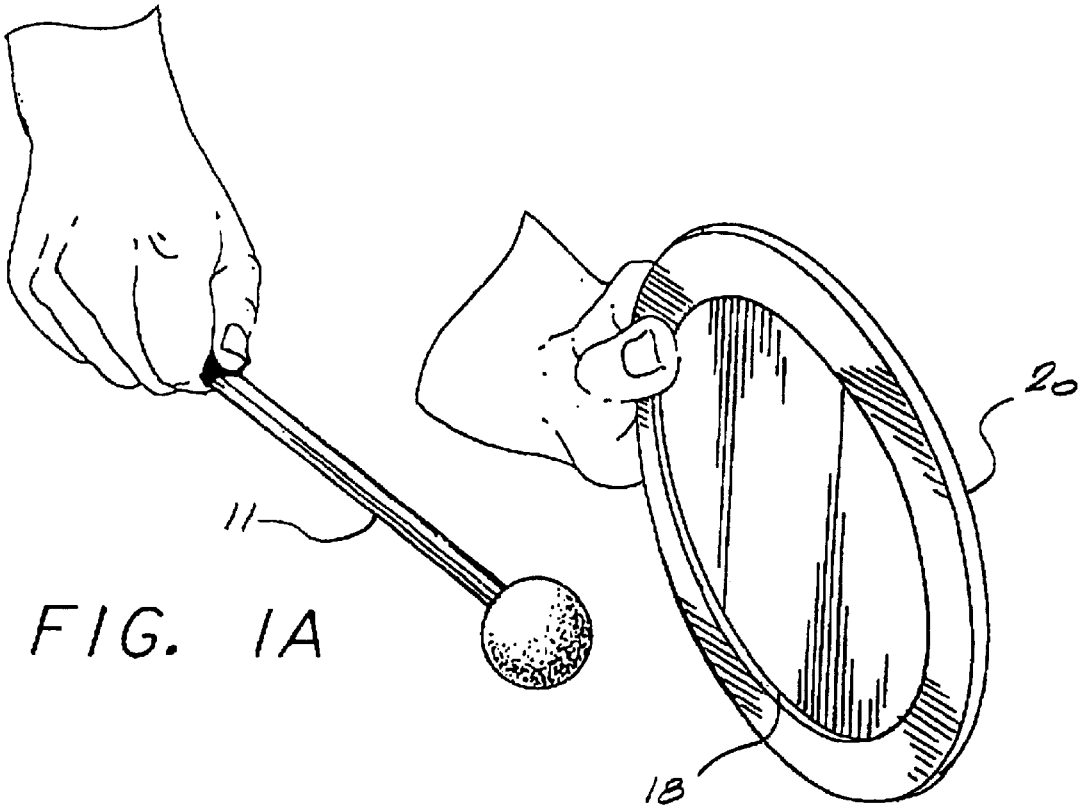
FIG. 1A is a perspective view of the drumhead of the present invention shown being held and played by a drummer.
Figure 6:
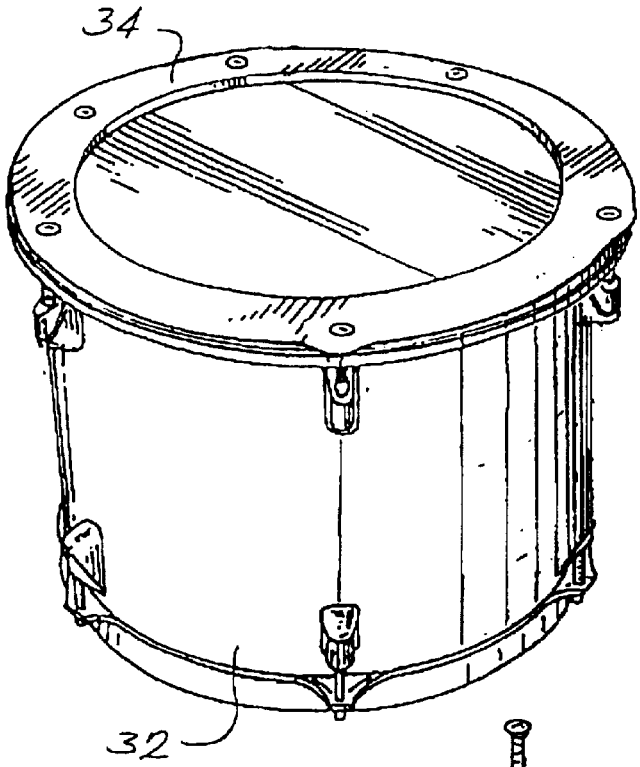
FIG. 6 is a perspective view of the drumhead of the present invention shown (with a flat counterhoop) installed and tensioned on a conventional drumshell.
Figure 7:
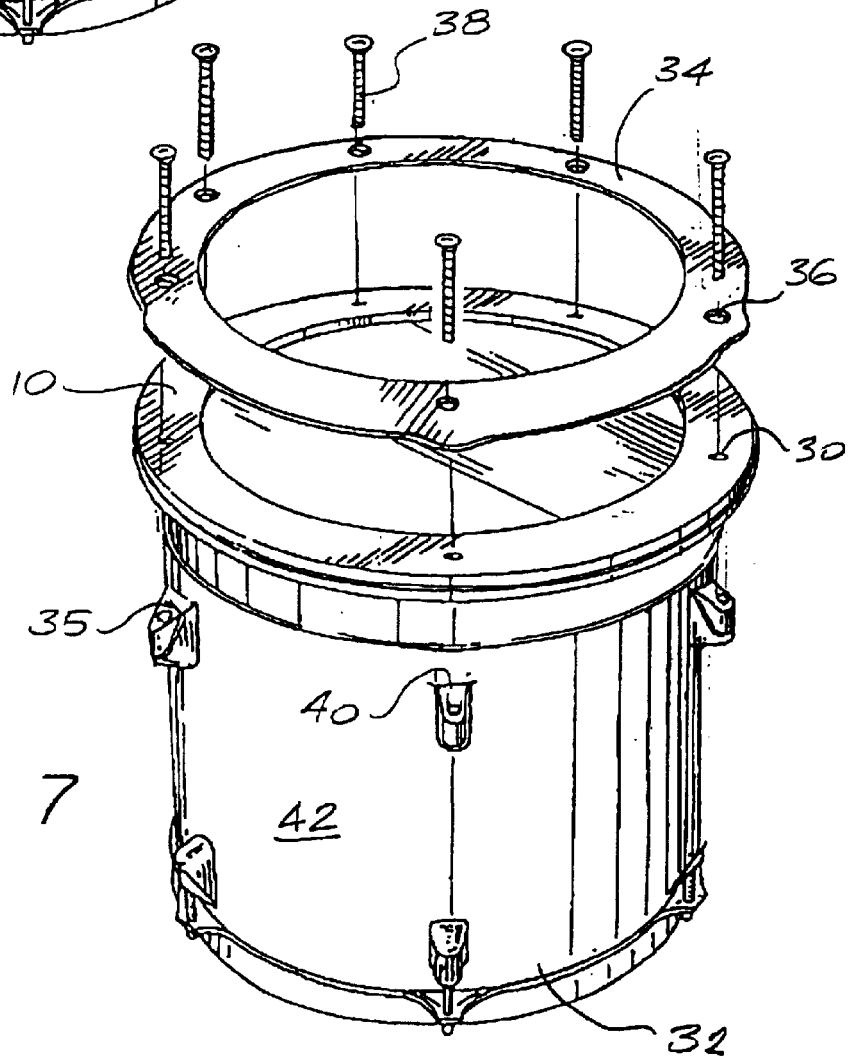
FIG. 7 is an exploded view of certain drum components shown in FIG. 6, including the drumhead of the present invention, depicting the manner in which the components are assembled.

In contrast with conventional drumheads, drumhead 10 is extremely versatile and can be played independently of a conventional drumshell (FIG. 1A) using a mallet 11 or any other suitable means to produce the desired sound. In such instances, the annular hoop 12 is the shell.

The typical drumhead is shaped, bent or formed to properly conform to a hoop, usually metal, which enables the film to be tensioned conventionally at right angles. By pulling the film over the shell's bearing edge, however, the film wrinkles. The sound produced by the vibrating membrane is the direct result of the shape, hardness and friction of and the degree of sound absorption by the bearing edge.

Drumhead 10 of the present invention is unaffected by these factors, especially "friction tension", since, in its preferred embodiment, there is no bearing edge to pull against. All components, namely annular hoop 12 and film material 22, are co-planar in their orientation. Thus, the film may vibrate freely. Numerous sounds, tones, rhythmic patterns and dampening techniques are more easily achieved by this invention.

When desirable to adapt drumhead 10 to a more standard drumshell 32, conventional drum lugs 35 can be employed in combination with openings 30 to secure the drumhead 10 to the shell 32 and tension the head accordingly. In this embodiment, it is preferable to use a flat counter-hoop 34. Openings 36, which are aligned with openings 30 in annular hoop 12, are adapted to receive rods or bolts 38 from the various tensioning mechanisms 40, which are affixed to walls 42 of conventional shell 32, to cooperate in the tensioning process. Tightening the bolts or rods 38 will increase the tensioning of the head. Flat counter-hoop 34 may vary in its size and thickness depending on a number of factors, including the size and thickness of the drumhead 10, the size and bulk of the drumshell 32 and certain economic factors. Shell 32 can range in height from as small as 1" to several feet or more, as desired.

In another embodiment, drumhead 10 can be adapted to be mounted and secured on the inside wall 44 of a standard drum shell 45. There, with the support of a shoulder mount 46, upon which the annular hoop 12 may rest, the head is fixed using a screw 47 or some other suitable means. A counter-hoop may or may not be employed. Typically, the drumhead 10 is positioned substantially, if not exactly, even with the edge 48 of shell 45 to enable the instrument to be played more easily, without obstruction.

In another embodiment (FIG. 8), drumhead 50 is constructed to include a striking surface 52 with a rim 54 and an annular shoulder 56 formed below rim 54. Peripheral section 58 of drumhead 50 is secured and bonded between components of annular hoop 60 comprised of generally planar upper member 62 and generally planar lower member 64. Drumhead 50 can be adapted to any conventional drumshell, modified, if necessary, or not, using a counterhoop and any suitable tensioning mechanism (not shown).

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended.

What is claimed is:

1. A drumhead comprising:

a substantially horizontal annular hoop having a generally flat, planar horizontal upper member and a generally flat, planar horizontal lower member parallel to and spaced apart from said generally flat, planar horizontal upper member, a circumferential inner rim and a circumferential outer rim lying in substantially planar relation relative to said generally flat, planar horizontal upper and lower members;

a material for constituting a drumming surface extending horizontally and flat across the area defined within said circumferential inner rim and continuing flat more than half the distance across the area defined between said circumferential inner rim and said circumferential outer rim, said material being generally co-planar with said horizontal annular hoop; and a means to secure said material for constituting a drumming surface between said generally flat, planar horizontal upper member and said generally flat, planar horizontal lower member of said horizontal annular hoop.

2. The invention of claim 1 wherein said annular hoop includes a means to secure said drumhead to a drum shell.

3. The invention of claim 2 wherein said means to secure said drumhead to a drum shell enables the tensioning of said material for constituting a drumming surface.

4. The invention of claim 1 wherein said planar upper member of said annular hoop comprises one or more layers of material.

5. The invention of claim 1 wherein said planar lower member of said annular hoop comprises one or more layers of material.

6. The invention of claim 2 wherein said means to secure said drumhead to a drum shell comprises a plurality of openings disposed within said annular hoop and corresponding bolt members adapted to engage said openings in a fastening relationship and connect to the drum shell to enable support for said drumhead and the tensioning of said material constituting a drumming surface.

7. The invention of claim 1 wherein said drumhead measures less than ⅜" in thickness.

8. The invention of claim 1 wherein said means to secure said material constituting a drumming surface between said planar upper member and said planar lower member of said annular hoop comprises an adhesive compound.

9. The invention of claim 1 wherein said means to secure said material constituting a drumming surface between said planar upper member and said planar lower member of said annular hoop comprises a plurality of spaced openings disposed within said annular hoop and corresponding insertable rivets or combinations of nuts and bolts.

10. The invention of claim 1 wherein no portion of said material constituting a drumming surface is bent.

11. The invention of claim 8 wherein said adhesive compound is a polyamide web adhesive.

12. The invention of claim 1 wherein said planar upper member and said planar lower member are comprised of fiberboard.

13. The invention of claim 1 wherein said planar upper member and said planar lower member are comprised of a synthetic material.

14. The invention of claim 1 wherein said material constituting a drumming surface is comprised of polyester.

15. The invention of claim 1 wherein said drumhead is pre-tensioned.

16. The invention of claim 1 wherein said drumhead is pre-tuned to produce a tone of a desired pitch.

17. The invention of claim 1 wherein said material constituting a drumming surface is comprised of more than one layer.

18. A drumhead comprising:

a generally flat, planar horizontal frame member having a generally flat, planar horizontal upper member and a generally flat, planar horizontal lower member parallel to and spaced apart from said generally flat, planar horizontal upper member, an inner rim and an outer rim lying in substantially planar relation relative to said generally flat, planar horizontal upper and lower members;

a material for constituting a drumming surface extending horizontally and flat across the area defined within said inner rim and continuing flat across the area defined between said inner rim and said outer rim to maximize the surface to surface contact between said material constituting a drumming surface and said generally flat, planar upper and lower members and ensure that said material constituting a drumming surface is fixably secured, said material constituting a drumming surface being generally co-planar with said horizontal frame member; and a means to secure said material constituting a drumming surface between said generally flat, planar horizontal upper and lower members of said horizontal frame member.

19. The invention of claim 18 wherein said frame member is square in shape.

20. The invention of claim 18 wherein said frame member is rectangular in shape.

21. The invention of claim 18 wherein said frame member is triangular in shape.

22. The invention of claim 2 wherein said drum shell comprises an interior shell wall and a circumferential edge, said drumhead being fixedly mounted to said interior shell wall generally even with said circumferential edge.

* * * * *